US009009882B2

(12) United States Patent
Bucher

(10) Patent No.: US 9,009,882 B2
(45) Date of Patent: Apr. 21, 2015

(54) HAND WASH WALL HUNG SINK TO AVOID SPREAD OF INFECTIOUS DISEASE

(75) Inventor: Christophe Bucher, Hillsborough, NJ (US)

(73) Assignee: AS IP Holdco, L.L.C., Piscataway, NJ (US)

( * ) Notice: Subject to any disclaimer, the term of this patent is extended or adjusted under 35 U.S.C. 154(b) by 474 days.

(21) Appl. No.: 12/975,357

(22) Filed: Dec. 22, 2010

(65) Prior Publication Data

US 2012/0151672 A1 Jun. 21, 2012

(30) Foreign Application Priority Data

Dec. 21, 2010 (MX) ..... MX/f/2011/000033

(51) Int. Cl.
*A47K 1/04* (2006.01)

(52) U.S. Cl.
CPC ..... *A47K 1/04* (2013.01)

(58) Field of Classification Search
CPC ..... E03C 1/18
USPC ..... 4/619–660
See application file for complete search history.

(56) References Cited

U.S. PATENT DOCUMENTS

| | | | | |
|---|---|---|---|---|
| 275,755 | A | 4/1883 | Elliott et al. | |
| 3,090,050 | A | 5/1963 | Fraser et al. | |
| 4,277,042 | A * | 7/1981 | Ash, Sr. | 248/447.1 |
| 4,587,680 | A | 5/1986 | Brugger | |
| 4,606,085 | A | 8/1986 | Davies | |
| 4,969,220 | A | 11/1990 | Raigneau | |
| 5,230,109 | A * | 7/1993 | Zaccai et al. | 4/645 |
| 5,452,484 | A * | 9/1995 | Hill | 4/658 |
| 5,611,093 | A | 3/1997 | Barnum et al. | |
| 5,819,335 | A * | 10/1998 | Hennessy | 4/619 |
| 6,016,578 | A * | 1/2000 | Malouf | 4/619 |
| 6,631,525 | B2 * | 10/2003 | Piatt et al. | 4/619 |
| 6,694,544 | B2 * | 2/2004 | Piatt | 4/661 |
| 7,039,963 | B2 * | 5/2006 | Loberger et al. | 4/639 |
| 7,228,574 | B2 | 6/2007 | Hansen et al. | |
| 7,240,380 | B2 * | 7/2007 | Erickson | 4/631 |
| 7,246,387 | B2 * | 7/2007 | Erickson et al. | 4/631 |
| 7,443,305 | B2 * | 10/2008 | Verdiramo | 340/573.5 |

(Continued)

FOREIGN PATENT DOCUMENTS

| | | | |
|---|---|---|---|
| JP | 10-295571 | A | 11/1998 |
| KR | 20-0196442 | Y1 | 7/2000 |

OTHER PUBLICATIONS

International Search Report for PCT/US2010/061686 dated Mar. 11, 2011.

(Continued)

*Primary Examiner* — Lori Baker
(74) *Attorney, Agent, or Firm* — Flaster/Greenberg, P.C.

(57) ABSTRACT

A sink is described herein which includes a basin including an upper rim having a back portion, and an interior surface having a sloped surface portion and a bottom surface portion, wherein the sloped surface portion extends from the back portion of the upper rim into the bottom surface portion; a faucet member extending upwardly from an upper portion of the sloped surface; and a drain opening extending through the bottom surface portion, wherein the faucet member is positioned such that liquid from the faucet member flows onto the sloped surface portion into the bottom surface portion and into the drain opening. A method for preventing splashing of a liquid from a sink is also provided herein.

16 Claims, 4 Drawing Sheets

(56) References Cited

U.S. PATENT DOCUMENTS

| | | | | |
|---|---|---|---|---|
| 7,469,430 | B2 * | 12/2008 | Thies | 4/516 |
| 7,523,511 | B2 * | 4/2009 | Marr et al. | 4/633 |
| D601,674 | S | 10/2009 | Hanna | |
| 8,181,289 | B2 * | 5/2012 | Schmitt et al. | 4/619 |
| D674,482 | S * | 1/2013 | Wurapa | D24/121 |
| 2002/0050006 | A1 | 5/2002 | Saraya | |
| 2007/0025874 | A1 | 2/2007 | Ophardt | |

OTHER PUBLICATIONS

Written Opinion of the International Searching Authority for PCT/US2010/016686 dated Mar. 11, 2011.

First Office Action for Chinese Patent Application No. 2010800708212, dated Jan. 21, 2015, 8 pages.

* cited by examiner

HAND WASH WALL HUNG SINK TO AVOID SPREAD OF INFECTIOUS DISEASE

BACKGROUND OF THE INVENTION

1. Field of the Invention

The invention is directed to a sink for use in an area where germs and infection can be problematic such as in a health care institution or similar area.

2. Description of Related Art

Sink designs for most hospital rooms and other areas requiring a sterile or clean environment, such as hospital rooms housing transplant patients, have shallow basins and high, gooseneck spouts that flow directly into the drain below. Because of this design, pressure from the spout tends to splash water out of the drain, which then sprays nearby surfaces. In some cases, splashing can extend as far as the head of the patient's bed and onto the preparatory counter. *Pseudomonas aeruginosa*, a common bacterium that thrives in drains where it forms what are known as biofilms, can trigger skin, wound or bloodstream infections or pneumonia in seriously ill hospitalized patients. These and other pathogens can be transported by water or other liquids in a liquid carrier fluid or biofilm. Sinks are placed in such rooms for the practice of having clean hands when before contact with patients. See, e.g., U.S. Patent Publication No. 2002/0050006 A1.

In addition, some scrub stations and other hospital sinks traditionally have a deeper basin area, but have a flat bottom that also can lead to similar splashing. See, e.g., U.S. Pat. No. 6,016,578.

There is a need in the art for a sink design for use near or in areas where a patient is being treated that avoids splashing in the patient area and/or showering a counter top or bed area with droplets of biofilms or other liquid particles carrying germs, viruses or bacteria, so as to help resist this cause of disease or infection to patients, especially those who are in a weakened condition and have a depleted immune response.

BRIEF SUMMARY OF THE INVENTION

The invention includes a sink comprising a basin including an upper rim having a back portion, and an interior surface having a sloped surface portion and a bottom surface portion, wherein the sloped surface portion extends from the back portion of the upper rim into the bottom surface portion; a faucet member extending upwardly from an upper portion of the sloped surface; and a drain opening extending through the bottom surface portion, wherein the faucet member is positioned such that liquid from the faucet member flows onto the sloped surface portion into the bottom surface portion and into the drain opening.

In one embodiment thereof, the back portion of the upper rim is generally planar so as to be mountable on a wall. The upper rim may extend away from the back portion in a generally U-shaped configuration. The sloped surface portion preferably has a generally flat section and a curved section approaching the bottom surface portion of the basin.

The faucet member preferably also has a faucet opening positioned such that liquid exiting the faucet opening contacts the sloped surface portion at a lower end portion of the generally flat section thereof. The bottom surface portion also preferably slopes downwardly toward the drain opening.

In another embodiment, the sink may include a faucet member having an automatic sensor. The sink may also further comprise a drain insert having a drain cover.

The invention also includes a method of preventing splashing of liquid from a sink, comprising providing a sink including a basin, a faucet member and a drain opening, wherein the basin includes an upper rim having a back portion, and an interior surface having a sloped surface portion and a bottom surface portion having the drain opening extending therethrough, wherein the sloped surface portion extends from the back portion of the upper rim into the bottom surface portion, the faucet member extends upwardly from an upper portion of the sloped surface, and the drain opening is situated in the bottom surface portion of the basin, wherein the faucet member is transversely offset from the drain opening; and introducing liquid through the faucet member so that the liquid contacts the sloped surface before contacting the bottom surface portion of the basin, and then flows along the bottom surface portion of the basin into the drain opening.

In one embodiment of the method herein, the method may further include minimizing the spread of germs and/or bacteria in the liquid or in a biofilm comprising the liquid.

The sloped surface portion may be configured so as to have a generally flat section and a curved section approaching the bottom surface portion of the basin, in which case the method may further comprise contacting the liquid to a lower end portion of the generally flat section prior to flowing over the curved section. Also, the bottom surface portion may slope downwardly toward the drain opening and the method may further comprise flowing the liquid from the faucet leaving the sloped surface along the bottom surface downwardly into the drain opening.

BRIEF DESCRIPTION OF THE SEVERAL VIEWS OF THE DRAWING(S)

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
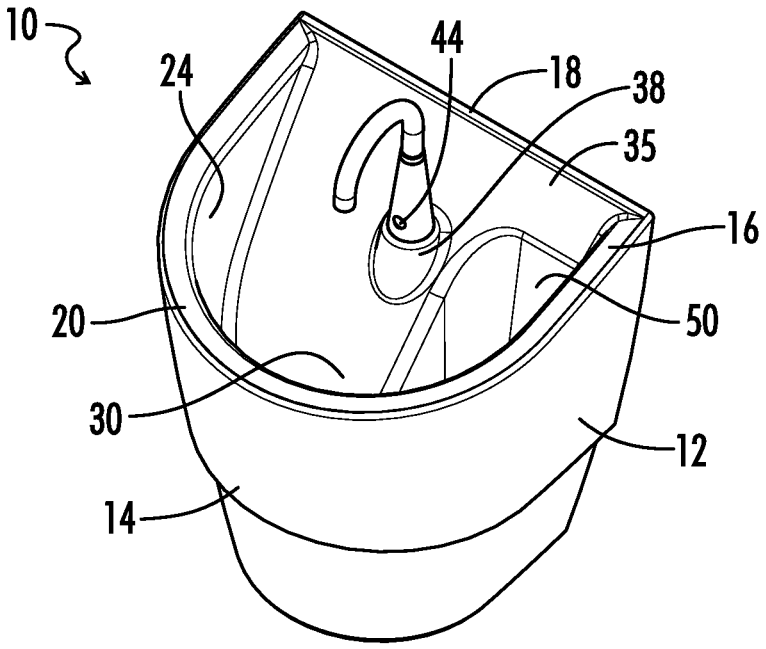
FIG. 1 is a perspective view of a sink according to an embodiment of the invention.

The inventors hereof have developed a hand wash sink for use in areas where cleanliness or sterile conditions are preferred, including hospitals, patient rooms, treatment areas, testing facilities, long-term care rooms, testing and laboratory areas, daycare centers, emergency rooms, ICU's, surgery areas and the like. The sink may be a wall hung sink. The sink is configured so as to limit the potential for splashing liquids such as water, and therefore also minimizes the spread of germs and/or bacteria in liquid splashing or biofilms so as to protect patients from exposure.

The sink includes a preferential positioning of a drain opening in the sink that is transversely offset from the position of the faucet member. As shown in the Figures herein the faucet member has a gooseneck spout which is offset from the drain opening. By doing so, the liquid, such as water, flows from the faucet opening, such as from the gooseneck spout, and does not directly shoot liquid towards the drain. Liquid at the bottom of the sink basin flows away through the drain opening, and while minimizing the potential for splashing because there is reduced pressure due to impact on the drain as occurs in prior art basin designs. By reducing splashing of water out of or off of the drain, it also reduces spraying of germs and/or bacteria in water or in biofilms from the drain area to nearby areas or back on the person washing their hands, and reduces the possibility of infecting patients.

Just below the spout, the bottom surface portion of the basin of the sink is preferably also inclined so as to slope downwardly toward the drain. This allows water to flow from the faucet member through the opening or spout, over the sloped portion of the basin surface and then onto the inclined bottom surface portion. This deflects the flow path with an angle, and the inclined bottom surface portion contributes to reducing the faucet water pressure. This will reduce splashing water out of sink, and furthermore, reduce spaying of bacteria and/or germs towards patients.

The invention includes a sink, generally referred to herein as sink 10. Such a sink may be of a variety of sizes and exterior shapes, and can be a pedestal or wall mounted design. In the embodiment shown herein, the sink is a wall-mounted sink 10, wherein the sink includes a basin 12 that has exterior wall 14 and an upper rim 16. The upper rim 16 may be of a range of thicknesses depending on design, and preferably is slightly angled downwardly and inwardly such that liquid that may touch the rim would be directed downwardly. The upper rim may also be a generally flat surface rim. In one embodiment, the rim can be sufficiently negligible so as to be only an upper edge of the exterior wall 14. In a preferred embodiment, the rim has a reasonable thickness to provide a barrier and is downwardly and inwardly sloped as noted above.

In the embodiment shown, the upper rim has a back portion 18 and an outwardly extending portion 20. The back portion 18 of the upper rim 16 is preferably generally planar in that it extends generally flat along a wall for mounting. The actual back surface of the sink in such case is also then preferably generally flat so as to fit against a wall in a wall-mounted configuration. A slight inward and downward slope on the interior portion of the rim is also preferred on the back portion 18 of the upper rim 16. The outwardly extending portion 20 of the upper rim may also be varied by design choice, however, it is preferred that regardless of the outside exterior shape/configuration of the outwardly extending portion 20 of the rim or of the exterior wall 14 of the basin, the interior surface is preferably configured to have smooth and/or curving surfaces as described elsewhere herein that direct water or liquids downwardly toward the drain while resisting splashing.

Figure 3:
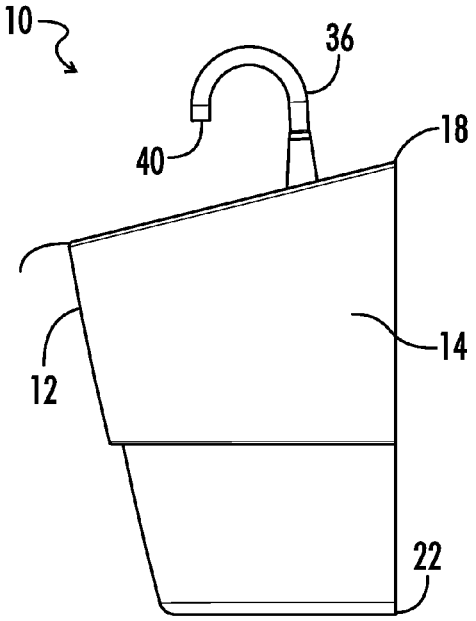
FIG. 3 is a left plan view of the sink of FIG. 1.
Figure 4:
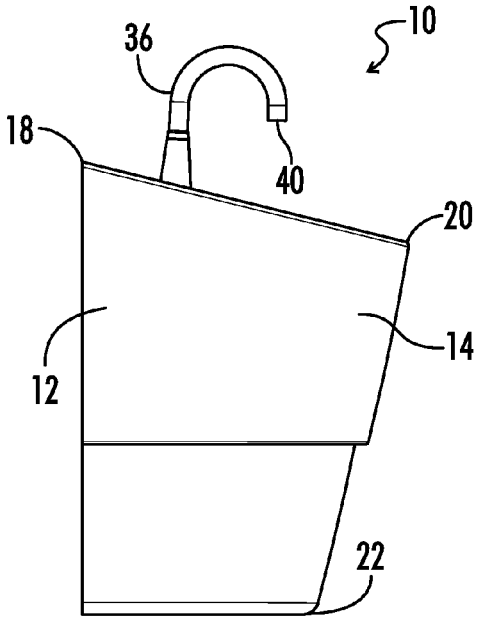
FIG. 4 is a right plan view of the sink of FIG. 1.
Figure 5:
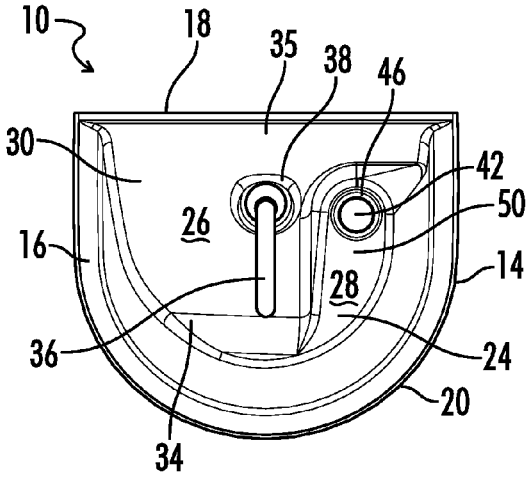
FIG. 5 is a top plan view of the sink of FIG. 1.
Figure 9:
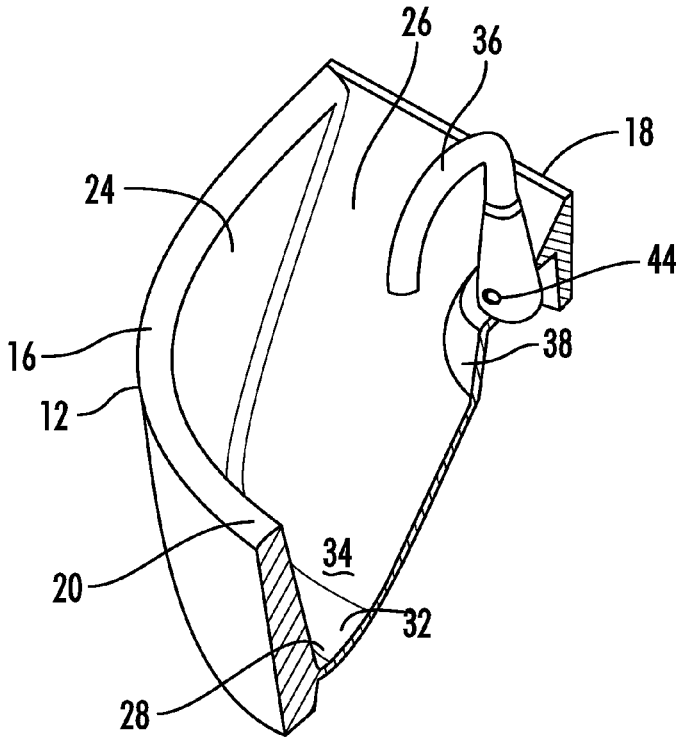
FIG. 9 is a longitudinal cross-sectional view of the upper basin portion of the sink of FIG. 1.
Figure 10:
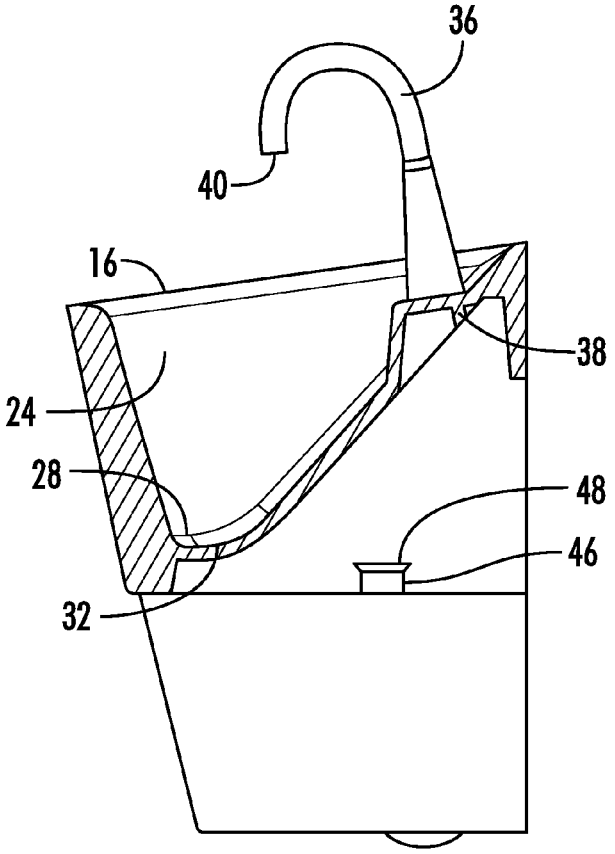
FIG. 10 is a partial cross-sectional view through the upper portion of the basin as shown in FIG. 9 on the lower portion of the basin.

The exterior wall may be a variety of configurations (square, rectangular, circular, ovoid, U-shaped, triangular, etc.). The exterior wall preferably slopes inwardly from the upper rim to the bottom 22 of the sink basin 12 for ease of use and design convenience in that as described further below (see FIGS. 3 and 4). The interior surface of the sink will be likewise sloped inwardly and downwardly (see, for example, FIGS. 9 and 10). Preferably the exterior wall 14 and the outwardly extending portion 20 of the upper rim 16 are also curved as shown, wherein the outwardly extending portion 20 of the upper rim 16 is preferably of a generally U-shaped configuration.

In the embodiment shown, the back portion 18 of the upper rim 16 is somewhat thinner than the outwardly extending portion 20 of the rim 16. On the outwardly extending portion 20 of the rim, the rim is preferably about 0.5 inches to about 2 inches in width measured transversely across the rim 16. More preferably, the rim is about 1 inch to about 2 inches, and most preferably about 1.5 inches to about 1.75 inches in width. The exterior wall in the preferred embodiment shown has a transverse width measured parallel to the back portion 18 of the upper rim is preferably about 15 to about 25 inches, preferably about 17 to about 20 inches. The sink basin preferably extends outwardly from the back portion at the upper rim about 10 to about 20 inches away from where the basin would wall mount, preferably about 15 to about 17 inches.

The basin 12 also has an interior surface 24 extending inwardly and downwardly from the upper rim 16 into the basin 12. The interior surface is described herein beginning with the portion of the interior surface near the back portion 18 of the upper rim 16. The interior surface 24 has a sloped surface portion 26 which extends from the back portion 18 of the upper rim 16 and terminates into a bottom surface portion 28 of the interior surface 24. The sloped surface portion 26 may be generally a sloped planar (flat) portion along its length or may be somewhat of an angled curve. As shown herein, the interior surface 24 preferably has a generally planar (flat) section 30 and a generally curved section 32, the latter of which is located in the area where the sloped portion 26 of the interior surface 24 approaches the bottom surface portion 28 of the basin. The sloped, generally flat section 30 extends downward from the upper rim at an angle with the horizontal of about 25 to about 75 degrees, preferably about 40 to about 60 degrees. If a curved section is included, a curved section 32 is preferably a generally smooth curved portion at a lower end portion 34 of the generally flat section that transitions flow of liquid down the sloped surface portion into the bottom surface portion of the interior surface 24. See, FIGS. 9 and 10, for example. Such a curve is easier to manufacture when the sink is made of chinaware, and is also typically easier to clean having less sharp transitions/corners.

At least partially down the sloped surface, in an upper portion 35 thereof, near the upper rim, and preferably positioned slightly downwardly and displaced from the upper rim is a faucet member 36. The faucet member 36 is preferably mounted in a preferred upwardly extending mounting piece 38 extending out of the interior surface on the sloped portion thereof. The faucet member 36 may be slightly angled downwardly for ease of installation and access to internal plumbing connections. The faucet member direct waters toward the sloped surface portion of the interior surface. The faucet mounting piece 38 is preferably positioned such that it is about 8 to about 12 inches, preferably about 9 to about 10 inches from the interior surface on the outermost extending portion of the upper rim. The opening 40 in the faucet member in a spout 42 thereof is positioned so that it is transversely offset from a drain opening in the bottom surface portion 28 of the basin. The opening is preferably aligned so as to direct liquid, such as water, to flow over the sloped surface portion onto the bottom surface portion 28.

The faucet member 36 extends upwardly from an upper portion 35 of the sloped surface 26 to direct liquid flowing over the sloped surface portion, preferably over the lower curved section 32 and into a drain opening 42 in the bottom surface portion 28. The faucet member 36 is positioned such that liquid from the faucet member flows onto the sloped surface portion into the bottom surface portion 28 and into the drain opening 42. The faucet opening 40 is preferably positioned such that after the liquid exits the faucet opening 40, it contacts the sloped surface portion 26 at the flat portion 30 thereof and then flows towards the lower end portion 34 of the generally flat section 30. The bottom surface portion 28 is preferably also configured so as to have an incline sloping downwardly toward the drain opening 42. The incline need not be too severe, and preferably varies from about 1 to about 15 degrees, preferably about 2 to about 5 degrees. As can be see in the rear view of FIG. 6 the bottom surface 28 will preferably curve slightly down to the drain.

The faucet member can have a variety of designs, including a vertically straight design, a slightly inclined design and the like. A slight incline as noted above, can assist in access during installation. The faucet may have various other design features known or to be developed in the art. Preferably the faucet is a design which is fixed in position and is non-rotational and non-movable so as to avoid potential splashing due to movement of the faucet member while in use. However, a moving faucet which can lock in place would also be useful in the invention. The manner in which the opening 40 of the faucet member is aligned can be such as to flow liquid straight downward at the vertical or at an angled with respect to the vertical. However it is configured, it should be designed so as to minimize any impact of splashing on its initial contact with the sloped surface portion and/or the bottom surface portion of the basin.

Figure 2:
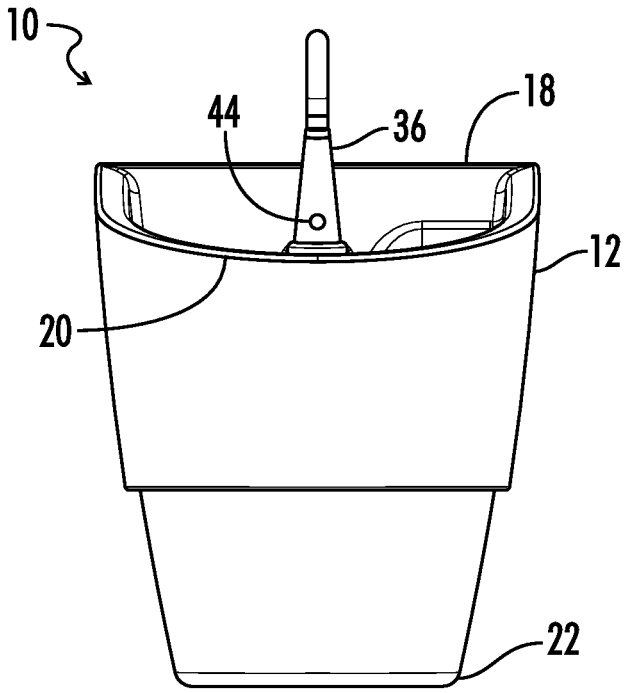
FIG. 2 is a front plan view of the sink of FIG. 1.
Figure 6:
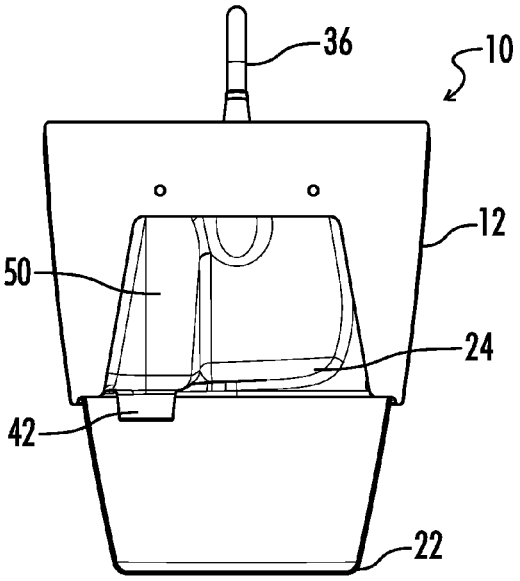
FIG. 6 is a rear plan view of the sink of FIG. 1.
Figure 7:
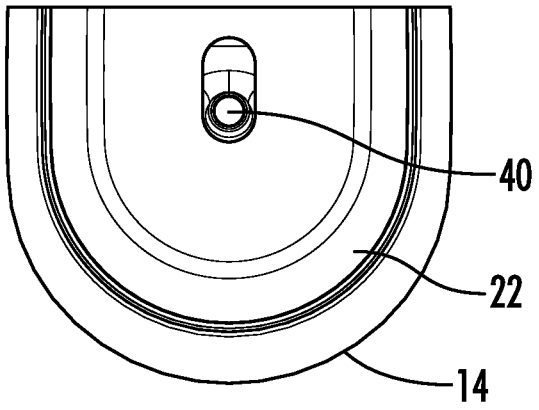
FIG. 7 is a bottom plan view of the sink of FIG. 1.
Figure 8:
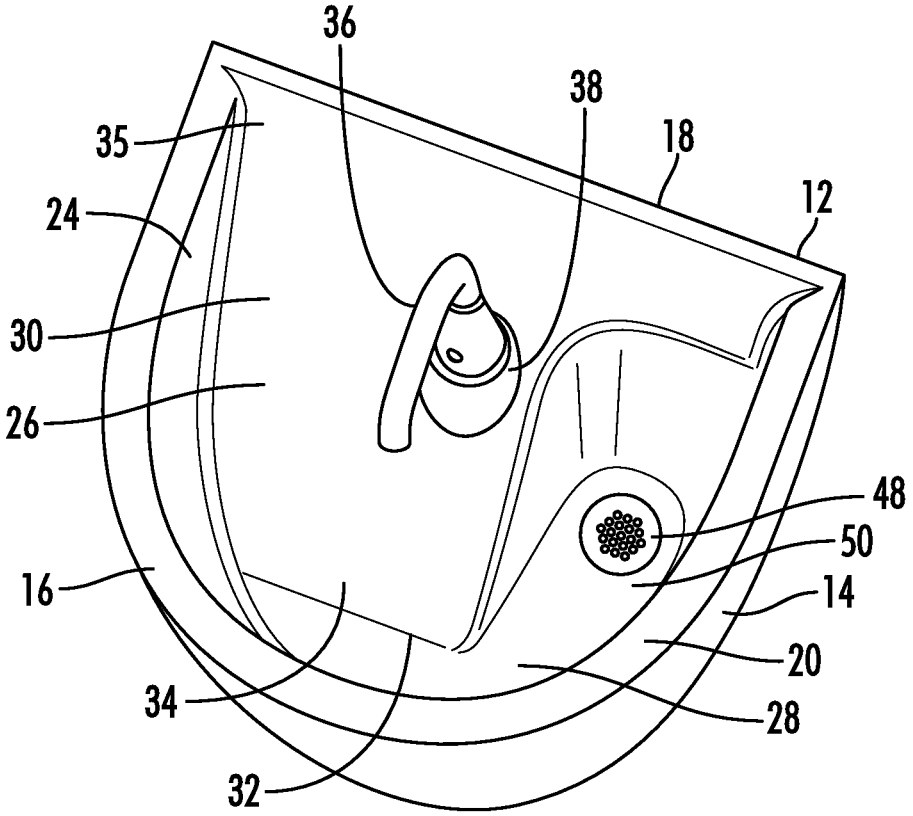
FIG. 8 is a perspective view of the sink of FIG. 1 demonstrating the drain and interior area.

To the extent that handles are to be avoided for fighting germ and/or bacterial surfaces, it is preferred that the faucet member having an automatic sensor 44. See FIGS. 1 and 2. Such a sensor may be any sensor known or to be developed in the art, for example, the type of sensor that activates faucet flow when a user interrupts an infrared signal by hand motion. Such automatic faucets are well known and should not be limiting to the invention hereof. The sink may also further include a drain insert 46 having a drain cover 48. The design of the drain and drain cover may also vary including a number of those known in the art or to be designed. The drain may have a stopper with activation, but preferably, the drain is an open drain to wash away germs and/or bacteria down the drain. As shown in FIG. 6, standard piping and/or hose connections to run hot and/or cold liquid such as water into the faucet member is preferably provided and connected on one end to the faucet member and/or fixtures and/or connectors related thereto, and the other end of the piping and/or hose connections would be attached to and/or in fluid communication with a liquid supply source, such as a water source.

The drain is positioned in a preferred embodiment in a recessed portion 50 of the bottom surface portion 28 of the interior surface. As shown in FIGS. 1, 5, 8 and 10, the sloped surface portion 26 is designed so as to not extend over the entire width of the basin as measured transversely. Instead, as the sloped portion preferably extends downwardly from the back portion 18 of the upper rim, the portion having the faucet member 36 continues downwardly to the bottom surface in a sloped manner. In the area of the recessed portion 50, the sloped surface portion 26 drops downwardly in a more vertical manner so as to define the recessed portion 50 having the drain opening 42 therein. Thus, as the liquid under the faucet runs down the sloped surface portion 26 under less pressure to the bottom surface portion 28, it enters a smaller area of the bottom surface portion 28 and flows around to the recessed portion 50 and into the drain opening 42. It would be understood by one skilled in the art, that the drain opening can be formed in other locations in the bottom or even the side surface, without departing from the spirit of the invention so long as it is transversely offset from the faucet opening.

The sink basin may be made so as to have a depth adequate to discourage splashing. In configuring the basin, the sloped surface portion should be configured to have a slope to encourage smooth flow of liquid onto the bottom surface portion of the interior surface of the basin, but keeping in mind that to maintain the slope with inadequate depth may make the sink too large or of an impractical design. As shown in the preferred embodiment herein, the interior surface in the outermost (front) portion of the basin slopes downwardly along the interior surface also to direct any liquid that hit the interior surface on the wall portion. Preferably, the depth is about 7 to about 15 inches, preferably about 8 to about 10 inches measured vertically.

The sink and basin may be formed of a variety of materials, including ceramic as is used with most sanitaryware, cleanable composite surface, molded thermoplastic (polyolefin, engineering plastics, acrylics, polycarbonates, and polyoxyalkylenes and the like), which materials may be filled or unfilled depending on the properties desired. The material formed for the sink and basin are preferably also formed so as to have a bacterial- and/or germ-resistant coating or material, and to be easily cleanable and disinfected with cleaning materials.

The invention also includes a method of preventing splashing of liquid from a sink. In such a method, a sink is provided, which includes a basin, a faucet member and a drain opening. The sink, basin, faucet member and drain opening may be such as those described above. As noted above, the sink and basin are configured such that the faucet member is transversely offset from the drain opening. Liquid is introduced through the faucet member so that the liquid contacts the sloped surface before contacting the bottom surface portion of the basin, and then flows along the bottom surface portion of the basin into the drain opening as described hereinabove. The method may further include minimizing the spread of germs and/or bacteria in the liquid or in a biofilm having the liquid which comes through the faucet member.

The sloped surface portion may be configured so as to have a generally flat section and an optional curved section as described above, wherein the curved section may be located in the area where the sloped surface approaches the bottom surface portion of the basin. The method may further include contacting the liquid to a lower end portion of the generally flat section prior to flowing over the curved section and onto the bottom surface. The bottom surface portion itself may also slope downwardly toward the drain opening as described above. The method may further include flowing the liquid from the faucet leaving the sloped surface along the bottom surface downwardly into the drain opening.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A sink comprising a basin including an upper rim having a back portion, and an interior surface having a sloped surface portion and a bottom surface portion, wherein the sloped surface portion extends from the back portion of the upper rim into the bottom surface portion, wherein the sloped surface portion and the bottom surface portion are configured to minimize the potential for splashing;

a faucet member extending upwardly from a location on an upper portion of the sloped surface, the faucet member being fixed in position; and a drain opening extending through the bottom surface portion, wherein the faucet member is positioned such that liquid from the faucet member flows onto the sloped surface portion into the bottom surface portion and into the drain opening;

wherein the faucet member is transversely offset from the drain opening.

2. The sink according to claim 1, wherein the back portion of the upper rim is generally planar so as to be mountable on a wall.

3. The sink according to claim 2, wherein the upper rim extends away from the back portion in a generally U-shaped configuration.

4. The sink according to claim 1, wherein sloped surface portion has a generally flat section and a curved section approaching the bottom surface portion of the basin.

5. The sink according to claim 4, wherein the faucet member has a faucet opening positioned such that liquid exiting the faucet opening contacts the sloped surface portion at a lower end portion of the generally flat section thereof.

6. The sink according to claim 1, wherein the bottom surface portion slopes downwardly toward the drain opening.

7. The sink according to claim 1, wherein the faucet member comprises an automatic sensor.

8. The sink according to claim 1, wherein the sink further comprising a drain insert having a drain cover.

9. A method of preventing splashing of liquid from a sink, comprising providing a sink including a basin, a faucet member and a drain opening, wherein the basin includes an upper rim having a back portion, and an interior surface having a sloped surface portion and a bottom surface portion having the drain opening extending therethrough, wherein the sloped surface portion extends from the back portion of the upper rim into the bottom surface portion, the faucet member extends upwardly from a location on an upper portion of the sloped surface and is fixed in position, the sloped surface portion and the bottom surface portion are configured to minimize splashing, and the drain opening is situated in the bottom surface portion of the basin, wherein the faucet member is transversely offset from the drain opening;

introducing liquid through the faucet member so that the liquid contacts the sloped surface before contacting the bottom surface portion of the basin, and then flows along the bottom surface portion of the basin into the drain opening.

10. The method according to claim 9, wherein the method further comprises minimizing the spread of germs and/or bacteria in the liquid or in a biofilm comprising the liquid.

11. The method according to claim 9, wherein the sloped surface portion has a generally flat section and a curved section approaching the bottom surface portion of the basin and the method further comprises contacting the liquid to a lower end portion of the generally flat section prior to flowing over the curved section.

12. The method according to claim 9, wherein the bottom surface portion slopes downwardly toward the drain opening and the method further comprises flowing the liquid from the faucet leaving the sloped surface along the bottom surface downwardly into the drain opening.

13. The sink according to claim 1, wherein the drain opening is located in a recessed portion of the bottom surface portion of the interior surface of the basin.

14. The method according to claim 9, wherein the drain opening of the sink is located in a recessed portion of the bottom surface portion of the interior surface of the basin, and the method further comprises introducing liquid through the faucet member so after the liquid contacts the sloped surface and the bottom surface portion of the basin, it flows along the bottom surface portion of the basin into recess and into the drain opening.

15. A sink comprising a basin including an upper rim having a back portion, and an interior surface having a sloped surface portion and a bottom surface portion having a recessed portion, wherein the sloped surface portion extends from the back portion of the upper rim into the bottom surface portion;

a faucet member extending upwardly from a location on an upper portion of the sloped surface, the faucet member being fixed in position; and a drain opening in the recessed portion and extending through the bottom surface portion, wherein the faucet member is positioned such that liquid from the faucet member flows onto the sloped surface portion into the bottom surface portion, into the recessed portion of the bottom surface portion and into the drain opening;

wherein the faucet member is transversely offset from the drain opening.

16. A method of preventing splashing of liquid from a sink, comprising providing a sink including a basin, a faucet member and a drain opening, wherein the basin includes an upper rim having a back portion, and an interior surface having a sloped surface portion and a bottom surface portion having a recessed portion, wherein the drain opening extends through the bottom surface, wherein the sloped surface portion extends from the back portion of the upper rim into the bottom surface portion, the faucet member extends upwardly from a location on an upper portion of the sloped surface and is fixed in position, and the drain opening is situated in the recessed portion in the bottom surface portion of the basin, wherein the faucet member is transversely offset from the drain opening;

introducing liquid through the faucet member so that the liquid contacts the sloped surface before contacting the bottom surface portion of the basin, and then flows along the bottom surface portion of the basin into the recessed portion of the bottom surface portion and into the drain opening.

* * * * *